United States Patent [19]

DeWolf et al.

[11] Patent Number: 4,601,584

[45] **Date of Patent: * Jul. 22, 1986**

[54] WRIST WATCH OR CLOCK ROSARY DEVICE

[75] Inventors: Lowell E. DeWolf, 666 San Mario Dr., Solana Beach, Calif. 92075; James J. Scrudato, 2796 N. Dalenhurst Pl., Simi Valley, Calif. 93065; Robert S. Wallace, 823 S. Longwood Ave., Los Angeles, Calif. 90005

[73] Assignees: Lowell E. DeWolf; James J. Scrudato; Robert S. Wallace, all of Solana Beach, Calif.

[ * ] Notice: The portion of the term of this patent subsequent to Dec. 21, 1999 has been disclaimed.

[21] Appl. No.: 450,644

[22] Filed: Dec. 17, 1982

Related U.S. Application Data

[63] Continuation-in-part of Ser. No. 265,042, May 18, 1981.

[51] Int. Cl.[4] ..... G04B 47/00

[52] U.S. Cl. ..... 368/10; 368/327

[58] Field of Search ..... 368/10; 340/807, 782

[56] References Cited

U.S. PATENT DOCUMENTS

| | | | |
|---|---|---|---|
| 3,086,911 | 4/1974 | Pripusich | 340/807 |
| 4,177,407 | 12/1979 | Goldstein | 361/195 |
| 4,365,246 | 12/1982 | DeWolf et al. | 340/782 |

FOREIGN PATENT DOCUMENTS 2505631 11/1982 France .

*Primary Examiner*—Bernard Roskoski
*Attorney, Agent, or Firm*—William W. Haefliger

[57] ABSTRACT

A rosary device on a wrist watch or clock has electrically energizable elements in a pattern, the elements having different characteristics corresponding to different rosary prayers.

12 Claims, 15 Drawing Figures

WRIST WATCH OR CLOCK ROSARY DEVICE

This application is a continuation-in-part of Ser. No. 265,042, filed May 18, 1981.

BACKGROUND OF THE INVENTION

This invention relates generally to wrist watch or clock rosaries, and more specifically concerns a rosary device which is electro-mechanical, and is well adapted to visually indicate the successive steps (corresponding to beads) of rosary prayers, in response to simple manual activation.

There is need for a simple rosary device or a wrist watch or clock adapted to manual activation, with the following characteristics:

(a) it may be easily activated to proceed through the prayer steps;
(b) it visually indicates the prayer steps;
(c) it may be used by injured or sick persons who cannot manipulate rosary beads;
(d) it can be selectively activated on a wrist watch or clock face.

SUMMARY OF THE INVENTION

It is a major object of the invention to provide a rosary device which will meet the above need.

Basically, the device comprises:

(a) a time-piece having a face with associated time indicating indicia,
(b) and Rosary terminals extending in a looping pattern at said face.

In addition, control means may be associated with said clock or watch to selectively effect energization of either said indicia or said terminals, for visibility.

As will appear, the energizable means may comprise LEDs or liquid crystals, in a matrix, and defining the illuminable terminals; the device wall structure may include a face with Rosary terminals and time indicia at the face; the terminals and indicia may be selectively made visible, and the Rosary terminals may be sequentially activated or made visible, and may be arranged in a heart shaped loop, as will appear.

These and other objects and advantages of the invention, as well as the details of an illustrative embodiment, will be more fully understood from the following description and drawings, in which:

DRAWING DESCRIPTION

Figure 1:
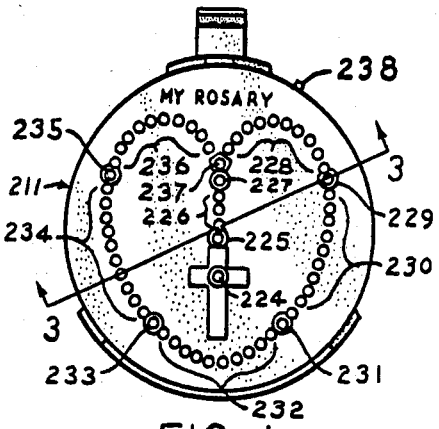
FIG. 1 is a front elevation showing a rosary device incorporating the invention.
Figure 3:
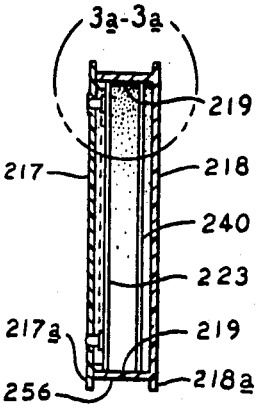
FIG. 3 is a section taken on lines 3—3 of FIG. 1.
Figure 2:
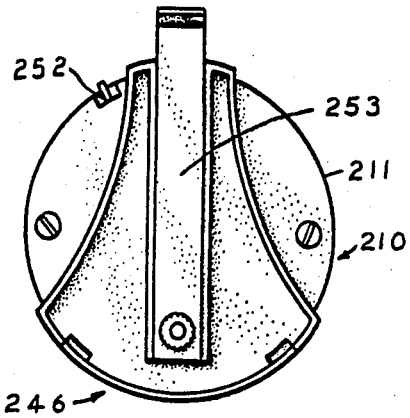
FIG. 2 is a rear elevation of the FIG. 1 device.
Figure 4:
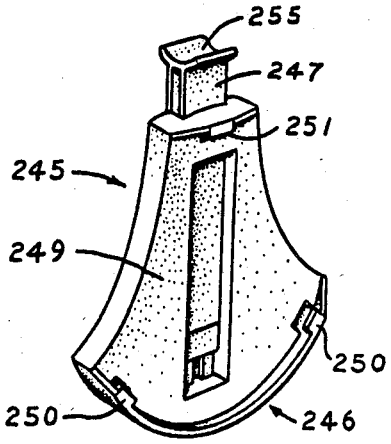
Figure 5:
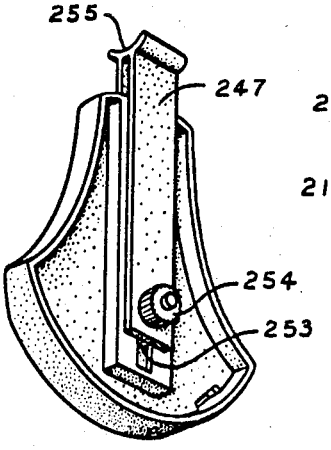
Figure 6:
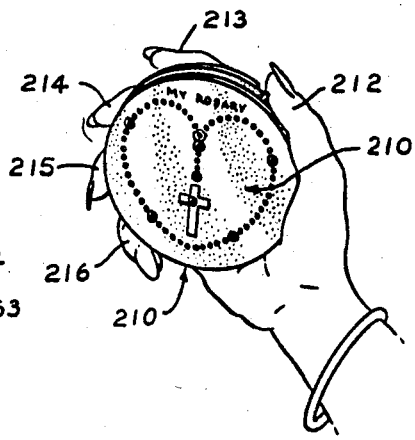
Figure 7:
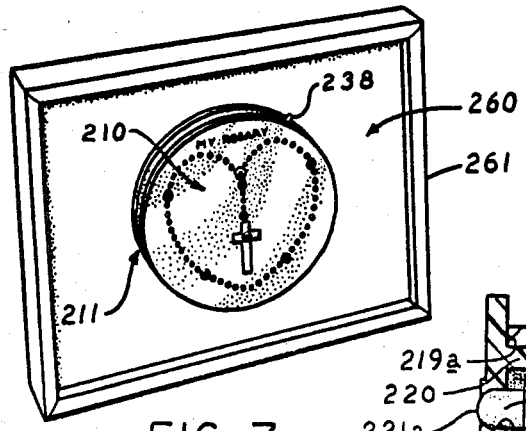
Figure 3A:
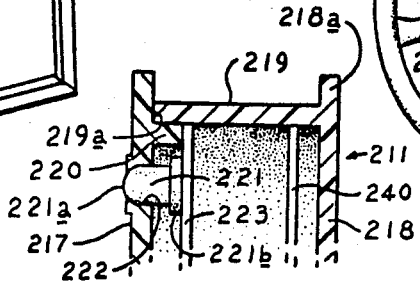
Figure 8:
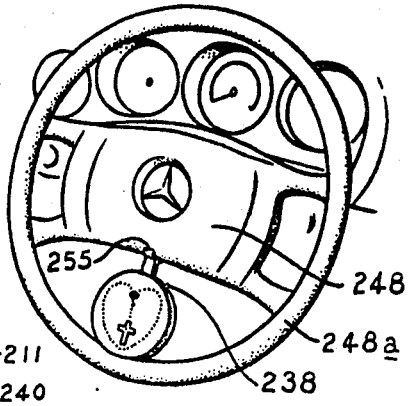
Figure 9:
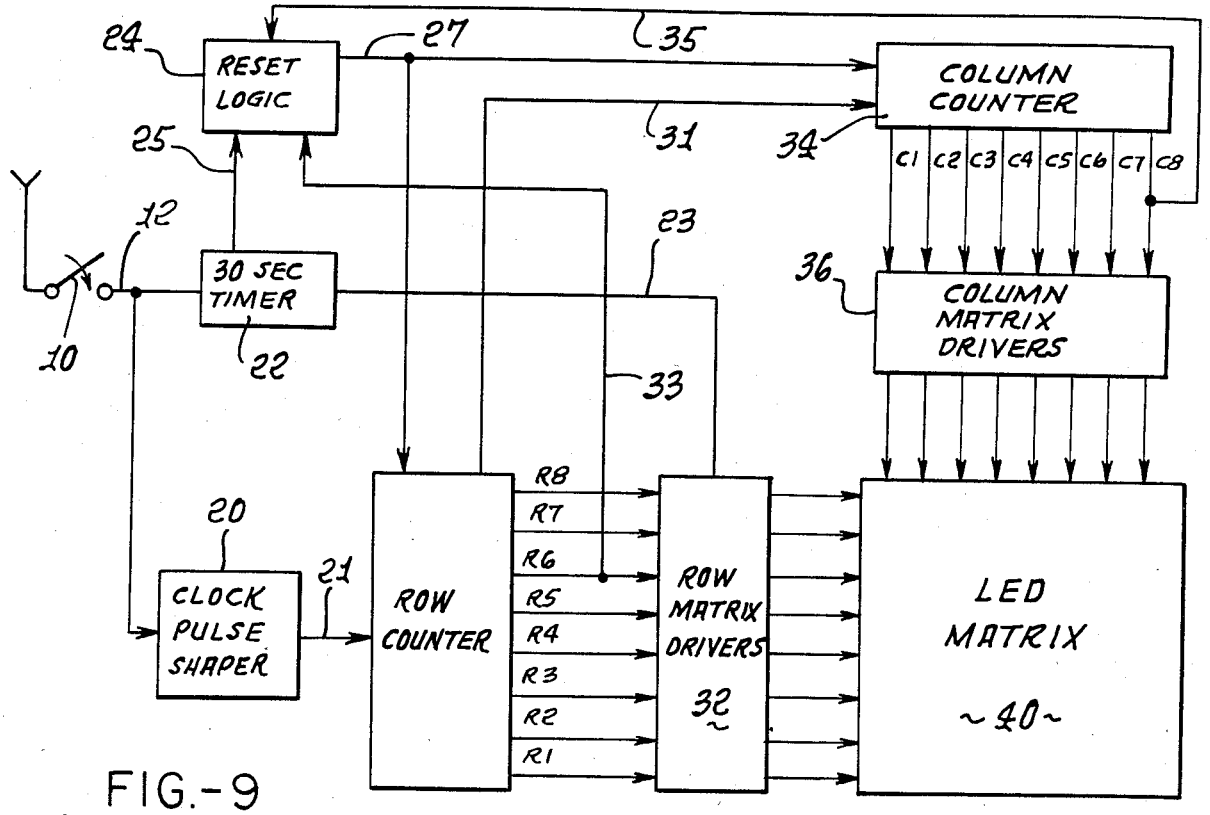
Figure 10:
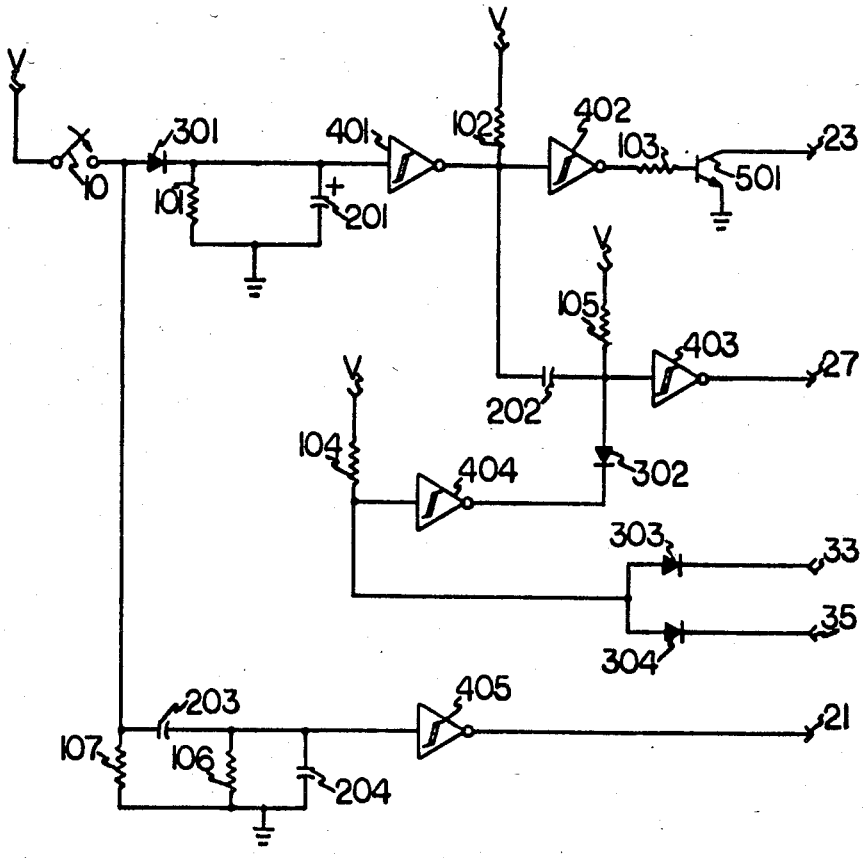
Figure 11:
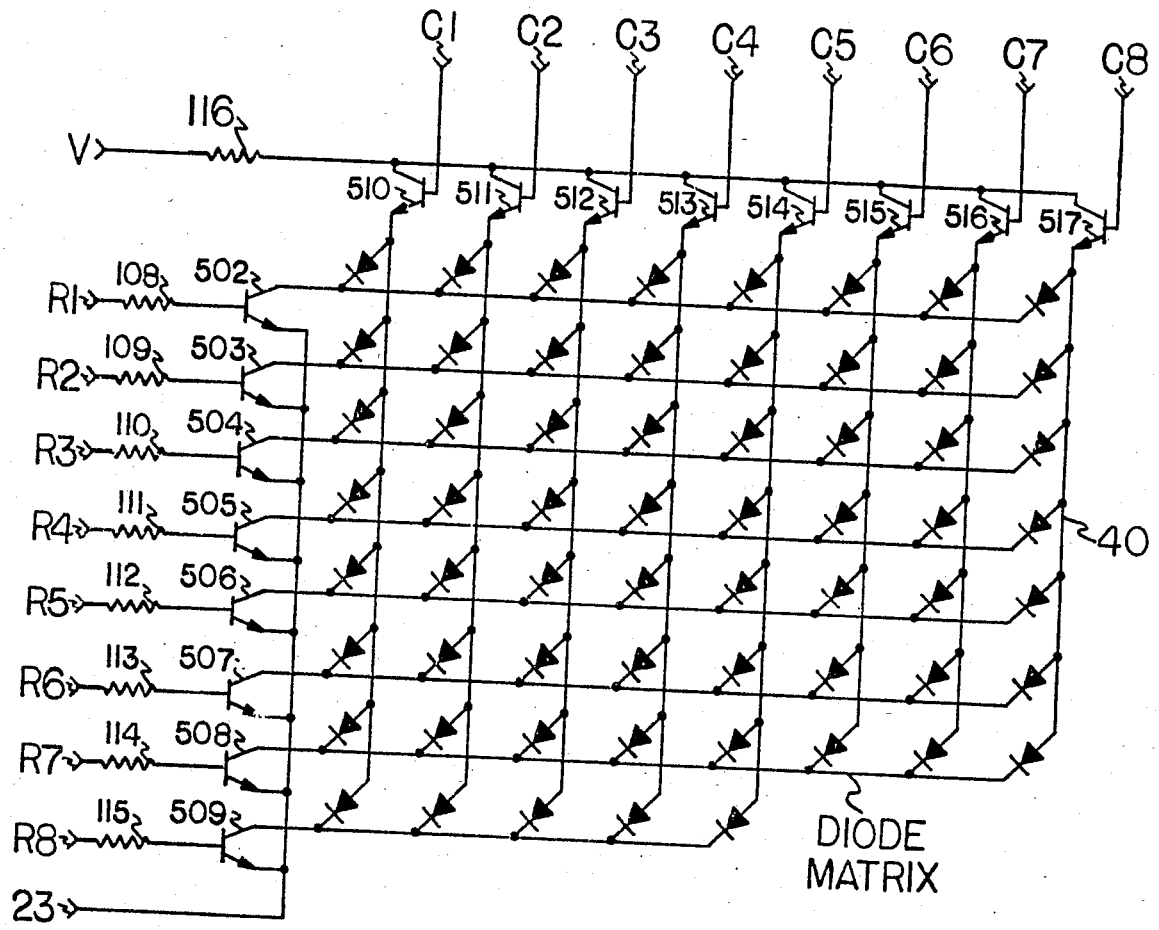
Figure 12:
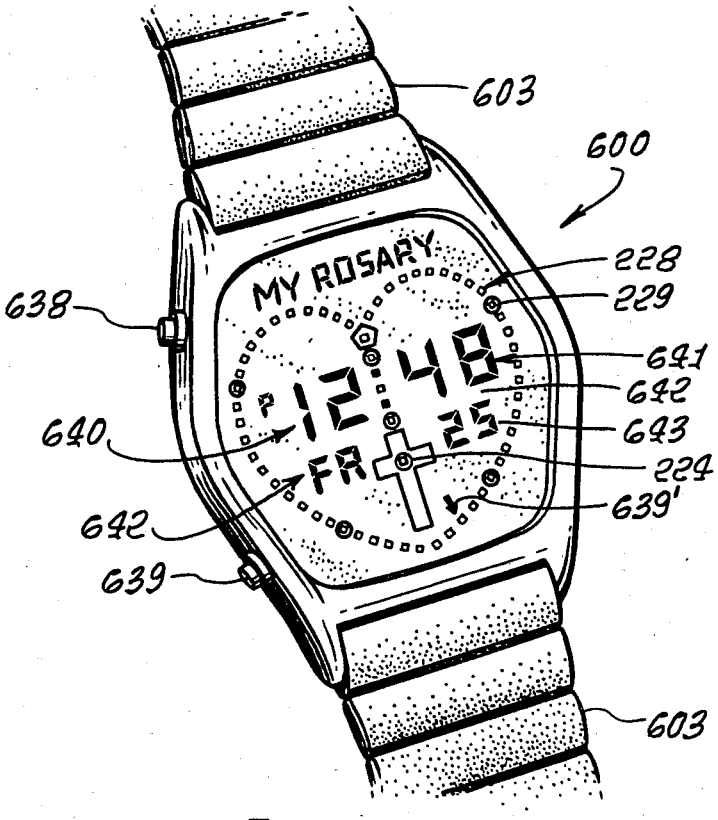
Figure 13:
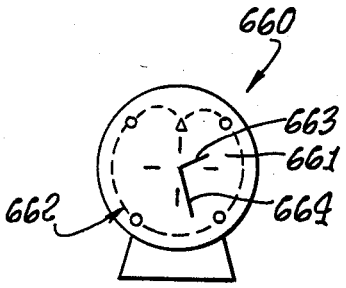

FIG. 3*a* is a fragmentary section taken on lines 3*a*—3*a* of FIG. 3;

FIG. 4 is a perspective view showing support means for the FIG. 1 device;

FIG. 5 is a perspective view showing the opposite side of the FIG. 4 support means;

FIG. 6 is a view showing hand holding of the FIG. 1 device;

FIG. 7 is a perspective view of a modified support for the FIG. 1 device;

FIG. 8 is a frontal view showing the FIG. 1 device and the FIG. 4 support attached to an automobile steering wheel;

FIG. 9 is a block diagram showing control circuitry for LEds;

FIG. 10 is a more detailed circuit usable for reset logic, timer and pulse shaper elements of FIG. 9;

FIG. 11 is a more detailed circuit diagram of diode and transistor elements in the matrix shown in FIG. 9;

FIG. 12 is a view of a wrist watch and Rosary;

FIG. 13 is a view of a clock face; and

Figure 14:
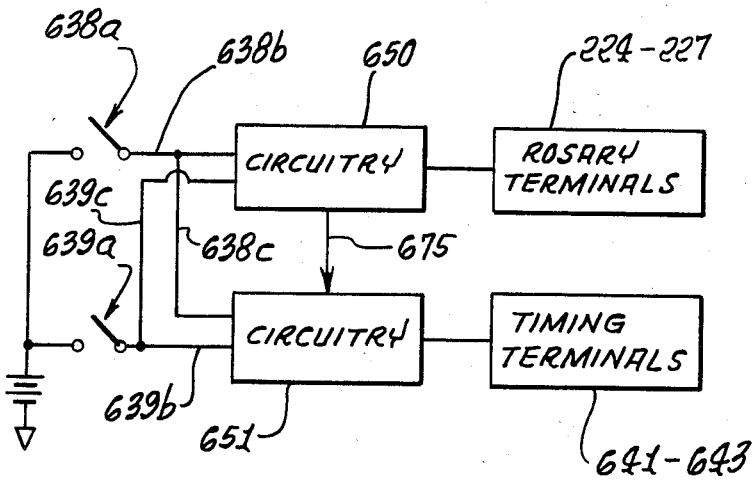

FIG. 14 is a block diagram.

DETAILED DESCRIPTION

In FIGS. 1–3 and 3*a* the Rosary device 210 comprises a casing 211 sized to be hand-held, as in FIG. 6, with thumb and fingers 212–216 extending about the generally circular casing periphery. The casing has wall structure that may for example include generally parallel front and rear walls 217 and 218, and side wall means extending between and joining the walls 217 and 218. The side wall means may comprise a cylindrical side wall 219 integral with wall 218, and abutting the inner side of front wall 217 at 219*a;* also, wall 219 may seat on or interfit with a stub wall 220 integral with front wall 217. Suitable adhesive may join wall 219 to walls 217 and 220.

Associated with the casing 211 is electrically energizable means having terminals proximate the wall structure (as for example wall 217) the terminals defining a loop. In the example, the electrically energizable means includes LEDs (see LED 221 in FIG. 3*a*) having terminals in the form of ends 221*a* exposed to the front side of wall 217, for viewing. For example, that wall may contain openings 222 into which the LEDs fit. The bases 221*b* of the LEDs may be carried on a front circuit board 223 within the casing, and extending parallel to wall 217, as shown.

Referring to FIGS. 1 and 6, the LED terminals are arranged in a heart shaped loop having a cusp defined by LED 237.

Certain of the LED terminals have a first characteristics indicative of a "Hail Mary" prayer to be spoken. See in this regard the groups 228, 230, 232, 234 and 236 of ten LEDs each arranged in the heart shaped loop, as shown. An additional group 226 of three "Hail Mary" LEDs is below the cusp. Others of the terminals have a second characteristic indicative of an "Our Father" prayer to be recited. See in this regard the LEDs 225, 227, 229, 231, 233 and 235 located as shown. The "Our Father" terminals may be relatively larger (i.e. have larger end terminals) than the "Hail Mary" LEDs, for example; or they may have color different from such LEDs, when energized, these being examples of the different characteristics referred to. Additional LEDs are shown at 224, (Sign of the Cross and Apostle's Creed); 225 (Our Father); and 237 (Hail Holy Queen).

In use, the user presses a switch button 238 at the periphery of the casing each time he completes a prayer, and the LEDs are successively illuminated as follows: first 224, next 225, then each of those in group 226 in sequence, then 227, then each of those in group 228, then 229, and on around the loop to 236, and finally 237. The switch 238 may be considered as part of a control means for controllably energizing the LEDs so that their terminals are successively and controllably illuminated, as described. The "Hail Mary", prayer, is spoken each time one of the LEDs in groups 226, 228, 230, 232, 234 and 236 is illuminated; and the "Our Father" prayer is spoken each time one of the LEDs 225, 227, 229, 231, 233 and 235 is illuminated. Additional prayers, as noted are spoken when the remaining LEDs are illuminated. The control means also includes electronic circuitry, to be described, which may be carried on a second circuit board 240 located within the casing, closer to rear wall 218, as shown in FIGS. 3 and 3*a*.

Also provided is support means on the casing to support the device for observation of the terminals, as referred to. One such support means comprises an adjustable bracket engageable with automobile steering wheel structure, to removably attach the device to the latter, so that the user may recite his rosary prayers while driving. See for example the bracket 245 of FIGS. 4, 5 and 8, having a clip portion 246 enabling removably attachment to the casing 211, and an arm 247 enabling removably attachment to the cross-piece 248 of steering wheel 248*a*. Clip portion 246 is shown to include a base 249 adapted to extend adjacent rear wall 218, and tabs 250 adapted to fit over a rear wall peripheral flange 218*a*. A third tab 251 fits over the same flange, after passage of that tab through a notch 252 in that flange, and rotation of the base about central axis 253 (see FIG. 2). Thus, the base is attached to the rear wall 218. The arm 247 has tongue and groove connection to the base portion at 253, so as to slide generally diametrically relative thereto. A set screw and knob 254 tightens the arm to the base in a selected fixed position. A concave head 255 on the end of the arm interfits the steering wheel cross-piece as shown in FIG. 8. At the same time, the channel 256 formed between front and rear wall peripheral flanges 217*a* and 218*a*, together with side wall 219, interfits the steering wheel inner rim, as shown in FIG. 8. Thus, when the interfits are accomplished, and knob 254 tightened, the device 10 is securely yet removably attached, in selected position to the steering wheel, enabling the user to pray with his Rosary, while driving. The support means shown in FIG. 7 comprises a plaque 260, centrally mounting the casing 211, and framed at 261.

An LED matrix 40 is shown in FIG. 11. There are 61 diodes illustrated, each representing one LED in the rosary. Row transistors 502–509 have collectors respectively connected as shown with rows of diodes, and their bases are energizable via input leads designated at $R_1$---$R_8$, in which resistors 108–115 are respectively connected. The transistors have their emitters connected with a lead represented at 23. Thus, when any lead such as $R_5$ is energized, the associated transistor, as at 506, is rendered conductive, and the row of diodes in the matrix connected with the collector of that transistor is enabled. Column transistors 510–517 have their collectors connected with a lead supplied with voltage V, via resistor 116. Their bases are energizable via input leads designated at $C_1$---$C_8$, and their emitters are connected with column leads which are in turn connected with columns of the diodes, as shown. Thus, if the bases of transistors 506 and 513 are both energized, the one diode at the intersection of the associated row and column is energized. The circuitry driving the input leads $R_1$---$R_8$ and $C_1$---$C_8$ is designed to sequentially energized the diodes. See for example the FIG. 9 row counter 30 and row matrix drivers 32, and the FIG. 9 column counter 34 and the column matrix drivers 36, these being connected as shown with the switch 10, 30 second timer 22, clock pulse shaper 20, and reset logic 24.

In FIG. 10, the timer circuitry is shown in greater detail at 101, 301, 201, 401, 402, 103, and 501. Elements of the reset logic appear at 403, 302, 104, 404, 102, 105 and 202, 303 and 304. Elements of the pulse shaper appear at 203, 107, 106, 204 and 405.

In operation, momentarily closing of switch 10 activates the timer 22 and clock pulse shaper 20. The timer enables the row drivers 32. Counter 30 is driven by the pulses at 21 of clock 20, and effects successive energization of the row inputs $R_1$---$R_8$ in the diode matrix, for each column input $C_1$---$C_8$.

Alternatively, the diodes in the matrix 40 can be considered to represent buzzers or other audio transmitters, so that the user can determine the sequence of prayer "stations", without viewing the front of the device.

More specifically, and referring to FIG. 10, when spring loaded switch 10 is momentarily closed, capacitor 201 charges to voltage V instantaneously through diode 301. This causes the output of Schmitt trigger 401 to switch from voltage V to ground. 401 is now in the "ON" state, and will remain ON for approximately 30 seconds. The latter is the time it will take 201 to discharge through resistor 101, at which time the input voltage at 401 will reach the "OFF" threshold input voltage, and 401 is output will switch back to voltage "V".

Two events begin simultaneously when 401 switches from V to ground. The falling edge of the output of 401 is capacitor coupled through 202, which discharges instantaneously toward ground and then begins to charge back to voltage V through resistor 105. The output of Schmitt trigger 403 line 27 switches during this time from ground to voltage V until capacitor 202 reaches the "ON" threshold input voltage of 403, causing 403 to switch back to ground. The output pulse 27 generated by 202, 105, and 403 initializes the row and column counters 30 and 34 respectively to state 1 in the count sequence. The 30 second pulse from 401 also drives the input to Schmitt trigger 402, causing 402's output to switch from ground to voltage "V". Current then flows to the base of transistor 501 through resistor 103. Transistor 501 begins to conduct current through its collector 23 and saturates, providing a ground path for the LED selected by the row and column counters 30 and 34. Also, when switch 10 is momentarily closed, capacitor 203 and resistors 106 and 107 provide a differentiation network. The voltage V will be present at the input of 405 instantaneously and then begin to decay toward ground. Resistor 107 provides a discharge path for 203 when switch 10 opens. Capacitor 204 provides debouncing of switch 10 contacts. The output of 405 will switch from voltage V to ground and remain at ground potential until capacitor 203 has charged up sufficiently to allow the input voltage of 405 to drop below the "ON" state threshold.

The output pulse of 405 is the clock pulse to row counter 30. Each time switch 10 is closed after the thirty second timer has been activated, the row counter 30 will advance by one. Each advance causes the next LED in the sequence to become lighted. After row counter 30 quantizes, it generates a clock pulse on output 31 which advances the column counter 34 by one, causing the next column of LEDs to be selected. Now the row counter 30 will repeat its count until it quantizes and clocks the column counter to column 3, etc. When the row counter line R6 is at voltage V and column counter line C8 is at voltage V, diodes 303 and 304 both become non-conductive allowing resistor 104 to pull the input of 404 to voltage V. The output of Schmitt trigger 404 falls from V to ground through diode 302. The output of Schmitt trigger 403 switches off and line 27 goes to V causing the counters to reset and start at the beginning of the cycle. The counter will count 61 clock pulses before resetting occurs. Once counters 30 and 34 are reset diodes 303 and 304 are once again conducting, causing 404 to switch OFF. Resistor 105 now pulls the input of 403 to V and 403 switches toward ground which removes the reset on line 27. Counters are now initialized to begin the sequence again.

If switch 10 is closed momentarily during the 30 second interval, the counters are clocked and the timer is retriggered for a new 30 second interval. If switch 10 is closed after the 30 seconds has timed out, the sequence is initialized to the beginning. The 30 second timer will allow the diode matrix 40 to have a completed circuit so the LEDs can conduct current through resistor 116 the selected row and column transistor and transistor 501 to ground. To conserve power when the circuit is not in use, the diode matrix 40 turned off by breaking the ground path at 23.

In FIG. 12, the wrist watch 600 has a casing 601, a facing 602, and a wrist band 603. The watch may also be considered as indicative of a clock with a face. The face has associated time indicating indicia, as well as Rosary terminals extending in a looping pattern at the face. See for example the Rosary terminals 224, 228, 229 and others corresponding to those indicated at 224–237 previously shown in FIG. 1. Those terminals may comprise liquid crystals and may be caused to become 'visible' when button 638 is pressed. When button 638 is further repeatedly pressed, Rosary terminals 224–237 are made sequentially visible, i.e. 'indicated', in sequence. Examples of being "made visible" are illumination (as in the case of LEDs), cursor designation in looping sequence (see cursor 639, for example, in FIG. 12), or 'deletion' (as for example, the terminal for which a prayer is being said becomes invisible). If desired, the terminals may be permanently formed (or appear at) the face 602, but sequentially made visible or indicated by the cursor in response to repeated pressing of the button 638. Suitable liquid crystals adjacent the Rosary terminals may be energized to define the cursor.

The time indicating indicia may likewise comprise liquid crystals and be caused to become 'visible' when the second button 639 is pressed. Such indicia may include hour and minute numbers or digits at 640 and 641; and months and day alphanumeric characters at 642 and 643.

In FIG. 14, the buttons 638 and 639 are represented by switches **638*a* and 639*a*. When switch 638*a* is closed, it energizes Rosary terminal circuitry in box 650, which functions as described above, and it also de-energizes the circuitry (known) in box 651 which controls the visibility and changing of timing indicia 640–643 as referred to. See paths 638*b* and 638*c*. Therefore, only the Rosary terminals (and the cursor, if used) then appear on the face 602**.

When switch **639*a* is closed, it energizes the time circuitry in box 651, and de-energizes the Rosary terminal circuitry in box 650. See paths 639*b* and 639*c*. Therefore, only the time indicating indicia then appear at face 602. It is possible to use one switch instead of two switches to control said Rosary and time functions. For example, one switch could be used for Rosary terminal control, as in FIGS. 1, 9, 10 and 11; and when allowed to "blank-out" the Rosary terminals, the circuitry could automatically activate the time indicia display. See for example connection 675 in FIG. 14**.

FIG. 13 shows a clock 660 with face 661, Rosary terminals 662, and time indicating hands 663 and 664, this being an analog time-piece to which the Rosary device is applied.

Other articles of jewelry to which the invention is applicable include pendants, bracelets, pocket watches, rings, medallions, and neck pieces.

If desired, words may be made to appear at the face adjacent the Rosary terminals to identify them as Hail Mary, Our Father, Apostle's Creed, and Hail Holy Queen. Such words may be formed by liquid crystals energized with the Rosary terminals. Such words may be used by themselves as the Rosary terminals.

We claim:

1. In combination, (a) a time-piece having a casing and face structure, and time indicating indicia at said face structure, (b) energizable means having terminals proximate said face structure, said terminals defining a loop or a portion of a loop, (c) and control means for controllably energizing said (b) means so that said terminals are succesively and controllably made visible, (d) certain of said terminals when visible having a first chracteristics indicative of a Hail Mary prayer, and others of said terminal when visible having a second characteristic indicative of an Our Father prayer, (e) said terminals being located proximate said time indicating indicia to be viewable when said face is observed, and said control means including a switch proximate said casing.

2. The combination of claim 1 wherein said (b) means includes LEDs defining at least some of said terminals.

3. The combination of claim 1 wherein said other terminals are larger than said first terminals.

4. The combination of claim 1 wherein said (b) means includes liquid crystals defining at least some of said terminals.

5. The combination of claim 1 wherein said terminals are arranged in a generally heart shaped loop having a cusp, one of said terminals and a crucifix symbol on the face structure being located within the heart shaped loop, and spaced from said cusp.

6. The combination of claim 1 wherein said time-piece has indicia proximate said face and indicative of a time sequence.

7. The combination of claim 6 wherein said time-piece comprises a wrist watch.

8. The combination of claim 6 wherein said control means includes a manually actuated part or parts operable to selectively energize said terminals and said indicia, whereby said Rosary terminals are presented in response to one operational mode of said part or parts, and said indicia are presented in response to another operational mode of said part or parts.

9. The combination of claim 8 wherein there are two of said parts in the form of push buttons on the casing.

10. The combination of claim 2 wherein said control means includes a diode and transistor matrix electrically connected with said LEDs to sequentially electrically energize said LEDs.

11. The combination of claim 5 wherein said control means includes a diode and transistor matrix, and circuit means to effect sequential energization of diodes in the matrix for pre-determined time intervals, in response to repeated operation of the switch.

12. In combination (a) an article of jewelry having a casing and face structure, (b) energizable means having terminals proximate said face structure, said terminals defining a loop or a portion of a loop, (c) and control means for controllably energizing said (b) means so that said terminals are successively and controllably made visible, (d) certain of said terminals when visible having a first characteristic indicative of a Hail Mary prayer, and others of said terminal when visible having a second characteristic indicative of an Our Father prayer.

* * * * *